US005524991A

United States Patent [19]

Yasunaga et al.

[11] Patent Number: 5,524,991

[45] Date of Patent: *Jun. 11, 1996

[54] PRINTING HEAD HAVING A ARMATURE BACKSTOP

[75] Inventors: Makoto Yasunaga, Kawagoe; Katsuya Masuda, Tokyo, both of Japan

[73] Assignee: Citizen Watch Co., Ltd., Tokyo, Japan

[ * ] Notice: The term of this patent shall not extend beyond the expiration date of Pat. No. 5,375,935.

[21] Appl. No.: 257,260

[22] Filed: Jun. 8, 1994

Related U.S. Application Data

[62] Division of Ser. No. 60,117, May 12, 1993, Pat. No. 5,375,935.

[30] Foreign Application Priority Data

May 18, 1992 [JP] Japan ..... 4-039262

[51] Int. Cl.[6] ..... B41J 2/235

[52] U.S. Cl. ..... 400/124.22; 400/124.11

[58] Field of Search ..... 400/167, 124.22, 400/124.01, 124.07, 124.11, 124.26, 124.32

[56] References Cited

U.S. PATENT DOCUMENTS

| | | |
|---|---|---|
| 4,320,981 | 3/1982 | Harrison et al. . |
| 4,367,962 | 1/1983 | Gaboardi . |
| 4,597,680 | 7/1986 | Norigoe et al. . |
| 4,978,238 | 12/1990 | Sato et al. . |
| 5,096,313 | 3/1992 | Horii . |
| 5,123,759 | 6/1992 | Horii et al. . |
| 5,163,761 | 11/1992 | Horii et al. . |
| 5,174,663 | 12/1992 | Asada et al. . |

FOREIGN PATENT DOCUMENTS

| | | | |
|---|---|---|---|
| 0205136 | 12/1983 | Germany | 400/167 |
| 62-231765 | 10/1987 | Japan . | |
| 1-53156 | 6/1988 | Japan | 400/167 |
| 3-62843 | 6/1991 | Japan . | |

*Primary Examiner*—John S. Hilten
*Attorney, Agent, or Firm*—Lowe, Price, LeBlanc & Becker

[57] ABSTRACT

A printing head comprising a plurality of armatures which are arranged radially and which are swingable before and behind, an armature stopper having armature abutting portions of cantilever type provided in projection toward a center in a radial direction at respective locations at the back of the armature for positioning the armatures under a waiting condition, the armature stopper being displaceable by impingement of the armatures, and a gap defined at the back of the armature abutting portions.

7 Claims, 5 Drawing Sheets

PRINTING HEAD HAVING A ARMATURE BACKSTOP

This is a division of U.S. patent application Ser. No. 08/060,117, filed on May 12, 1993, now U.S. Pat. No. 5,375,935.

BACKGROUND OF THE INVENTION

1. Field of the Invention

The present invention relates to a printing head for a dot printer.

2. Related Art And Prior Art Statement

A printing head for a general dot printer comprises a plurality of needles arranged in a retractable manner within a tubular needle holder, swingable armatures connected respectively to rearward ends of the respective needles, an armature stopper arranged rearwardly of the armatures for regulating backward positions of the respective armatures, springs for biasing respectively the armatures rearwardly, and solenoids provided correspondingly to the armatures. When any one of the solenoids is energized, the corresponding armature is attracted to move the needle forwardly. A forward end of the needle projects from the needle holder to perform printing. When energization of the solenoid is released, the armature is moved backwardly and impinges against the armature stopper. Noises are generated by an impact at the time the armature impinges against the armature stopper.

In view of the above, in order to solve the above-discussed problem, a printing head is disclosed in Japanese Patent Laid-Open No. 62843/1991 in which a resilient or elastic element is provided for being abutted against rearward ends of respective wires to absorb the impact. However, the printing head is such that, when the wires are repeatedly abutted, the elastic element is abraded or worn off by the impact, and the wires are cut into the elastic element so that the printing head is difficult to operate normally when the wires are again released from the elastic element.

Further, an impact dot head is disclosed in Japanese Patent Laid-Open No. 231765/1987 in which a metallic spacer and a rubber spacer which are polymerized to each other are arranged as a buffer material on lever abutting portions.

The above-described impact dot head has the following problems. That is, it is possible to absorb the impact by the rubber spacer, and The metallic spacer is provided on the surface of the rubber spacer. Accordingly, There is no case where returned levers cut into the rubber spacer. Printing can normally be performed even after stoppage for a long period of time. The impact dot head is rich in durability. However, since The rubber spacer is provided on a rear surface of the metallic spacer, the number of parts increases. Not only this forms a primary factor of an increase in cost, but also it is difficult to produce thickness accuracy of the rubber space. Thus, if the accuracy of this portion is poor, variation is apt to occur in printing performance.

OBJECTS AND SUMMARY OF THE INVENTION

It is an object of the invention to provide a printing head which is simple in structure, which is low in cost, in which variation in printing performance, is low to which impact at the time an armature is returned to a waiting or stand-by condition is relieved, and generation of noises is prevented from occurring.

According to the invention, there is provided a printing head in which armature abutting portions have high elasticity, and an impact at the time armatures impinge against an armature stopper is absorbed by the fact that the armature abutting portions are flexed or deflected and are displaced toward a gap therebehind. Thus, noises are restrained or suppressed, and the durability of the armature stopper is considerably improved.

Furthermore, since armatures are positioned only by the armature abutting portions of the armature stopper, other inclusions such as an elastic element, a damper and the like are not required. A structure is simple. Precision processing or working of the inclusion is not required. Thus, the cost is reduced, and the accuracy can easily be raised. Variation is difficult to occur in printing performance.

The printing head according to the invention is arranged such that the plurality of armatures are positioned under a waiting condition at a position at the back of the plurality of armatures which are arranged radially and which are swingably supported, an armature stopper is provided which has armature abutting portions which are displaceable by impingement of the armatures, the armature abutting portions project toward a center in a radial direction, a gap is defined at the back of the armature stopper, and the armature abutting portions are supported such that inward ends of the respective armature abutting portions are displaceable toward the gap.

When excitation of a coil stops, and when the armatures are returned to the original condition and impinge respectively against the armature abutting portions, the armature abutting portions are displaced toward the gap by resiliency or elasticity of the armature abutting portions and presence of the gap at the back of the armature abutting portions, to absorb the impact upon the impingement.

DETAILED DESCRIPTION OF THE PREFERRED EMBODIMENTS

Figure 1:
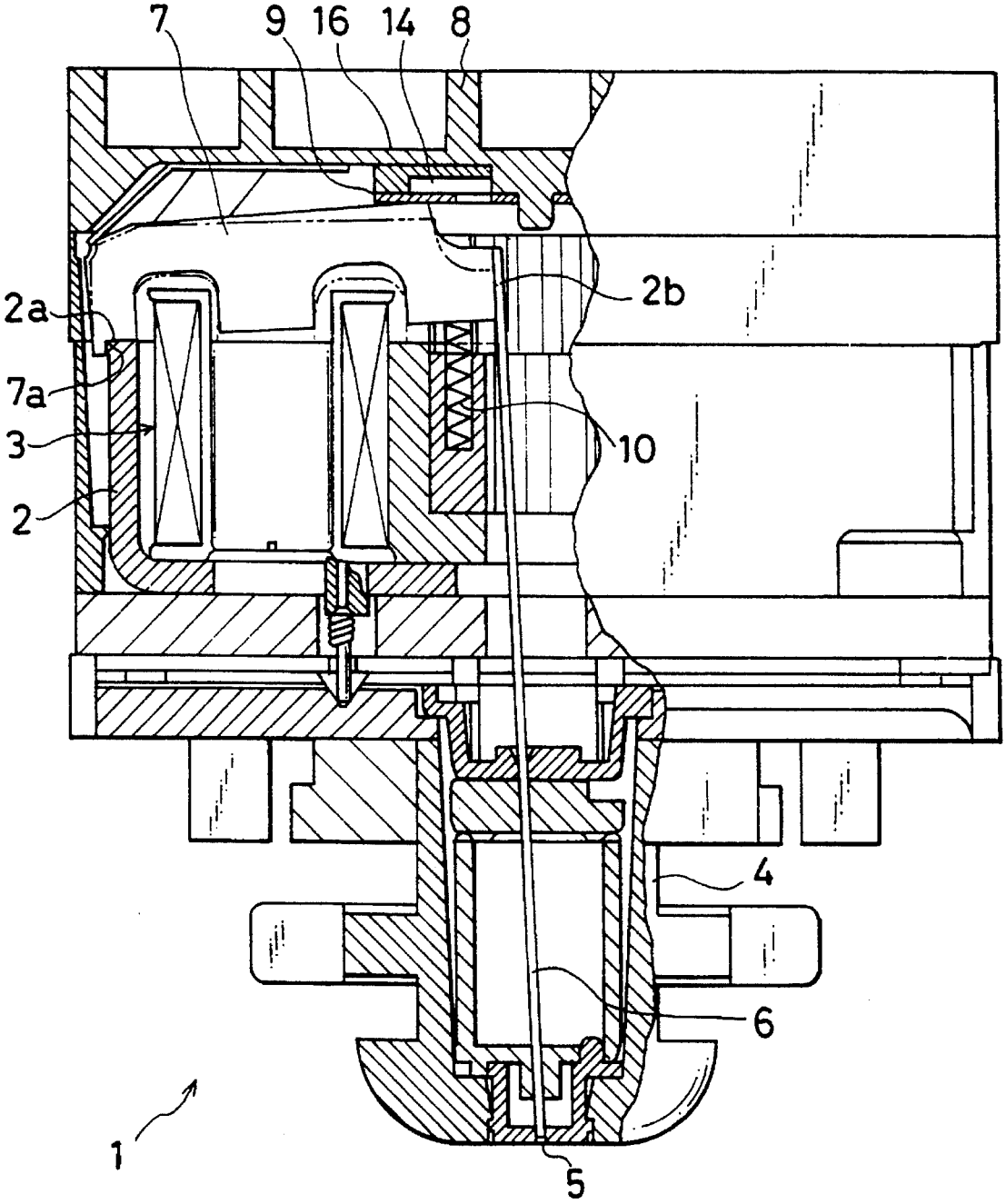
FIG. 1 is a partially broken side elevational view of a printing head, which shows an embodiment of the invention.
Figure 2:
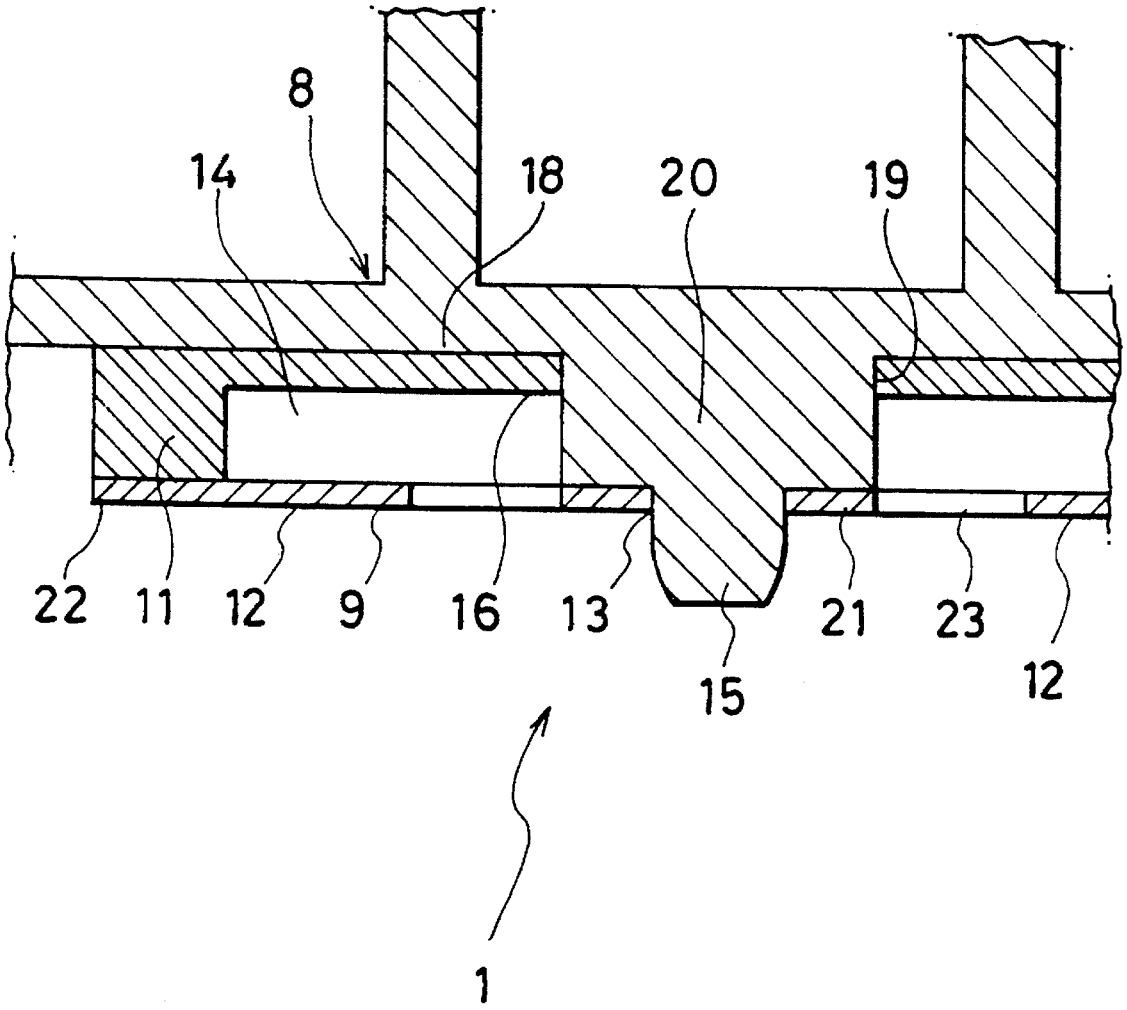
FIG. 2 is an enlarged side elevational cross-sectional view of a principal portion shown in FIG. 1.

In FIG. 1, a printing head 1 comprises a plurality of electromagnets 3 arranged within a solenoid base 2 along a periphery of the printing head 1 concentric with the solenoid base 2, a plurality of needles 6 extending through a tubular needle holder 4 so provided as to project from a center of a front surface of the solenoid base 2 and arranged in a retractable manner from openings 5 at a forward end of the needle holder 4, armatures 7 connected respectively to rearward ends of the respective needles 6, an armature base 8 provided rearwardly of the armature 7, an armature stopper table 16 mounted on a front surface of the armature base 8, and an armature stopper 9 provided on an entire surface of the armature stopper table 16 for regulating backward positions of the respective armatures 7.

The armatures 7 are confronted respectively against rearward portions of the respective electromagnets 3 and are arranged radially along a radial direction of the printing head 1. The armatures 7 are supported by a rearward edge 2*a* of the solenoid base 2 so as to be swingable in a longitudinal direction with inner corners 7*a* adjacent to the outer periphery of the printing head 1 serving respectively as fulcrums.

Further, the needles 6 have respective rearward ends thereof which are fixedly mounted respectively on ends 2*b* of the respective armatures 7 adjacent to a center of the printing head 1. Compression springs 10 which are provided at the center of the printing head 1 are abutted respectively against front surfaces of the respective armatures 7. Under a condition that the electromagnets 3 are not energized or deenergized, the armatures 7 are moved rearwardly by biasing forces of the respective compression springs 10. The armatures 7 are abutted against the armature stopper 9, and the forward ends of the respective needles 6 plunge into the needle holder 4.

Moreover, when any one of the electromagnets 3 is energized, the armature 7 corresponding to the energized electromagnet 3 is attracted so that the needle 6 moves forwardly. The forward end of the needle 6 projects from the opening 5 at the forward end of the needle holder 4. Thus, printing is performed.

Figure 3:
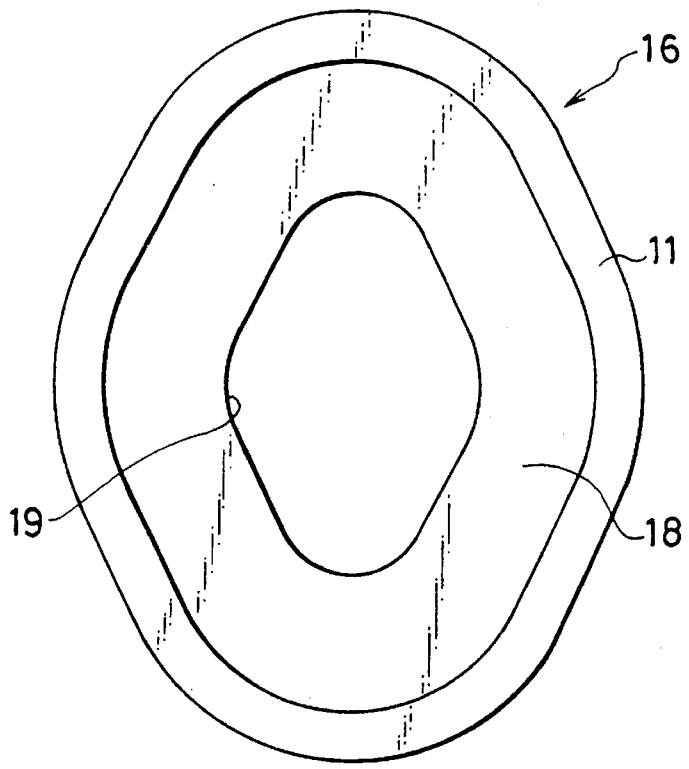
FIG. 3 is a top plan view of an armature stopper base according to the embodiment of the invention.

A material of the armature stopper table 16 is a plastic material which is the same in material as the armature base 8. A material of the armature stopper 9 is that high in wear and abrasion resistance such as a cobalt-group alloy or the like. As shown in FIG. 3, the armature stopper table 16 has a through bore 19 which is formed through a center of a board 18. An annular projection 11 is provided along an outer periphery of the annular stopper 10 at a front surface of the board 18. A convexity 20 projecting from a center of a front surface of the armature base 8 is inserted into the through bore 19, whereby the armature stopper table 16 is mounted on the center of the front surface of the armature base 8.

Figure 4:
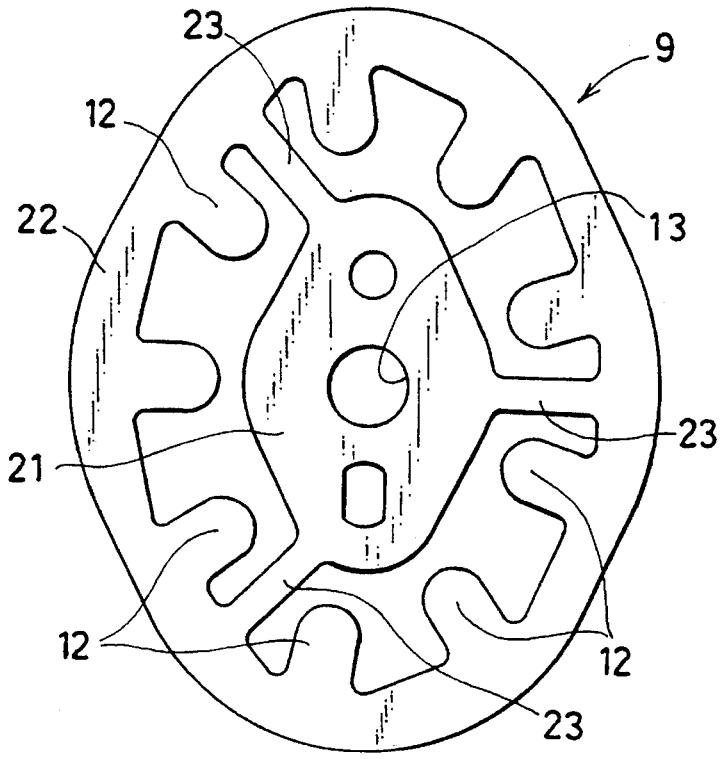
FIG. 4 is a top plan view of an armature stopper according to the embodiment of the invention.

The armature stopper 9 is made of a plate element having a top plan configuration which is substantially the same as that of the armature stopper table 16. As shown in FIG. 4, a through bore 13 is formed at a center of a central board 21 which is abutted against the front surface of the convexity 20 on the armature base 8. An annular portion 22 is provided along the outer periphery of the annular stopper 9 in spaced relation to the central board 21. Armature abutting portions 12 each in the form of a tongue piece, which position respectively the armatures 7 under the waiting condition, are so formed as to project toward the center of the armature stopper 9 in a radial direction at positions which are confronted against the rearward portions of the respective armatures 7 on the inner periphery of the annular portion 22. The central board 21 and The annular portion 22 are integrally arranged by connections Moreover, a projection 15 provided at the center of a front surface of the convexity 20 on the armature base 8 is inserted into the inserting bore whereby the armature stopper 9 is mounted on the front surface of the armature stopper table 16. At this time, since the projection 11 on the armature stopper table 16 is abutted against the rear surface of the annular portion 22, a gap 14 is defined between the annular stopper 9 and the base 18 of the armature stopper table 16 at the back of the armature abutting portions 12.

When energization of the electromagnets 3 is released, and when The armatures 7 are moved rearwardly so as to impinge against the armature abutting portions 12 of the armature stopper 9, the armature portions 12 are flexed or deflected toward the gap 14 to absorb the impact, and the armatures 7 are positioned.

In the embodiment, since the armature abutting portions 12 are partially formed, the embodiment has high elasticity or resiliency, is apt to be flexed or deflected by the impact, and is high in impact absorbing effects.

Figure 5:
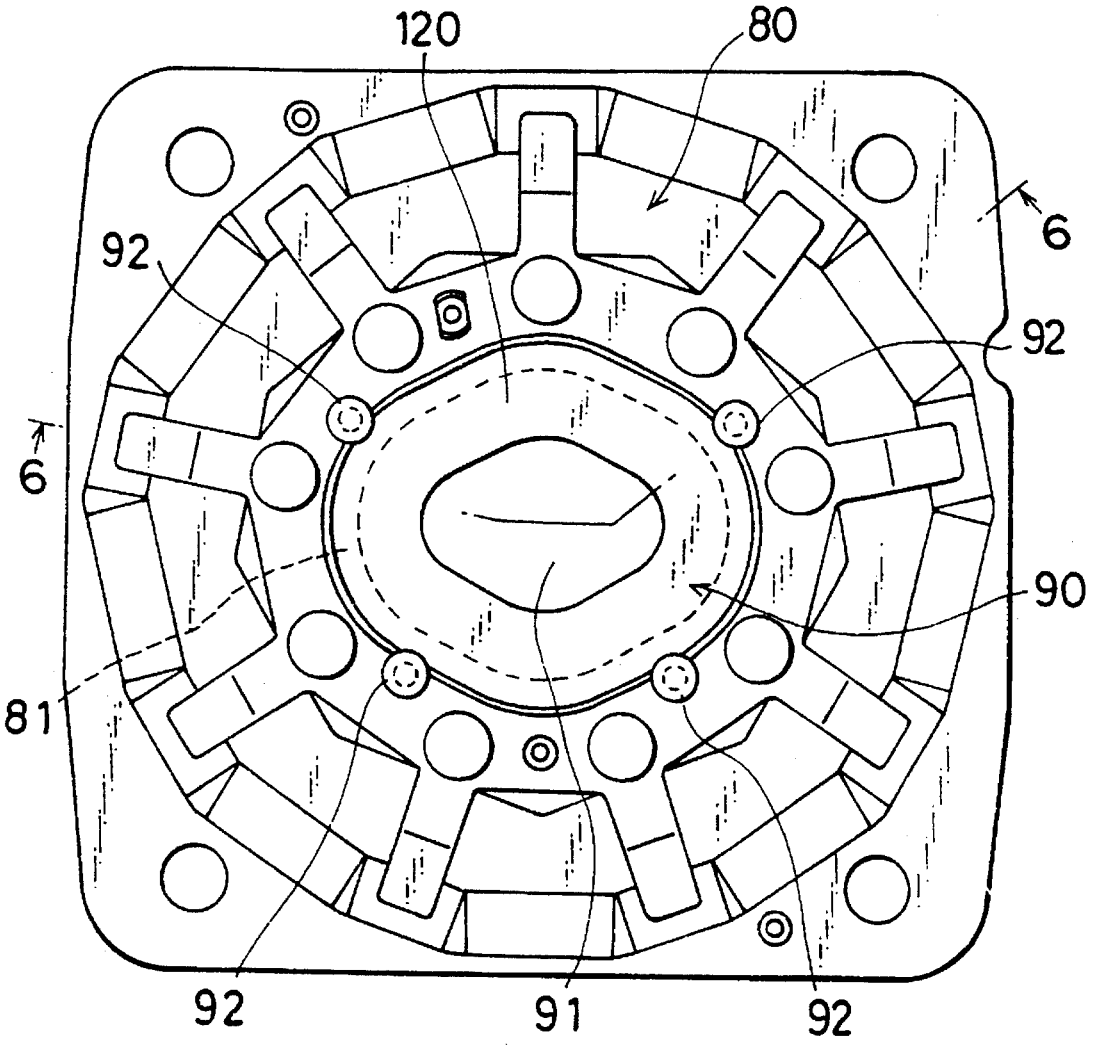
FIG. 5 is a top plan view of an armature base and an armature stopper according to another embodiment of the invention.
Figure 6:
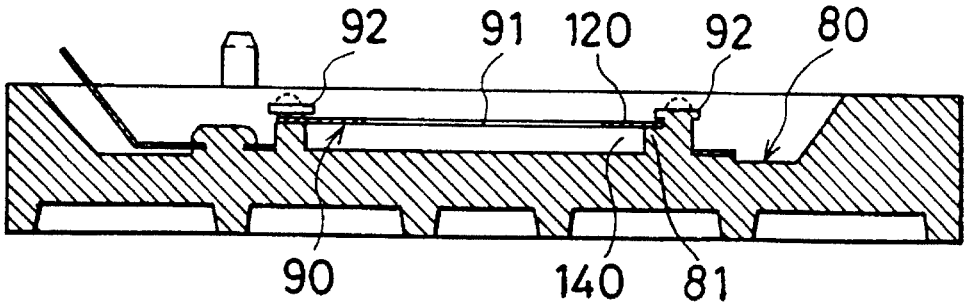
FIG. 6 is a cross-sectional view taken along a line A—A in FIG. 5.

FIGS. 5 and 6 show another embodiment of the invention. The convexity 20 and the projection 15 in the first embodiment are not provided on a center of a front surface of an armature base 80. However, an annular standing wall 81 is integrally formed in substitution for the armature stopper table 16. An armature stopper 90 is directly mounted on a forward end surface of the standing wall 81.

Figure 7:
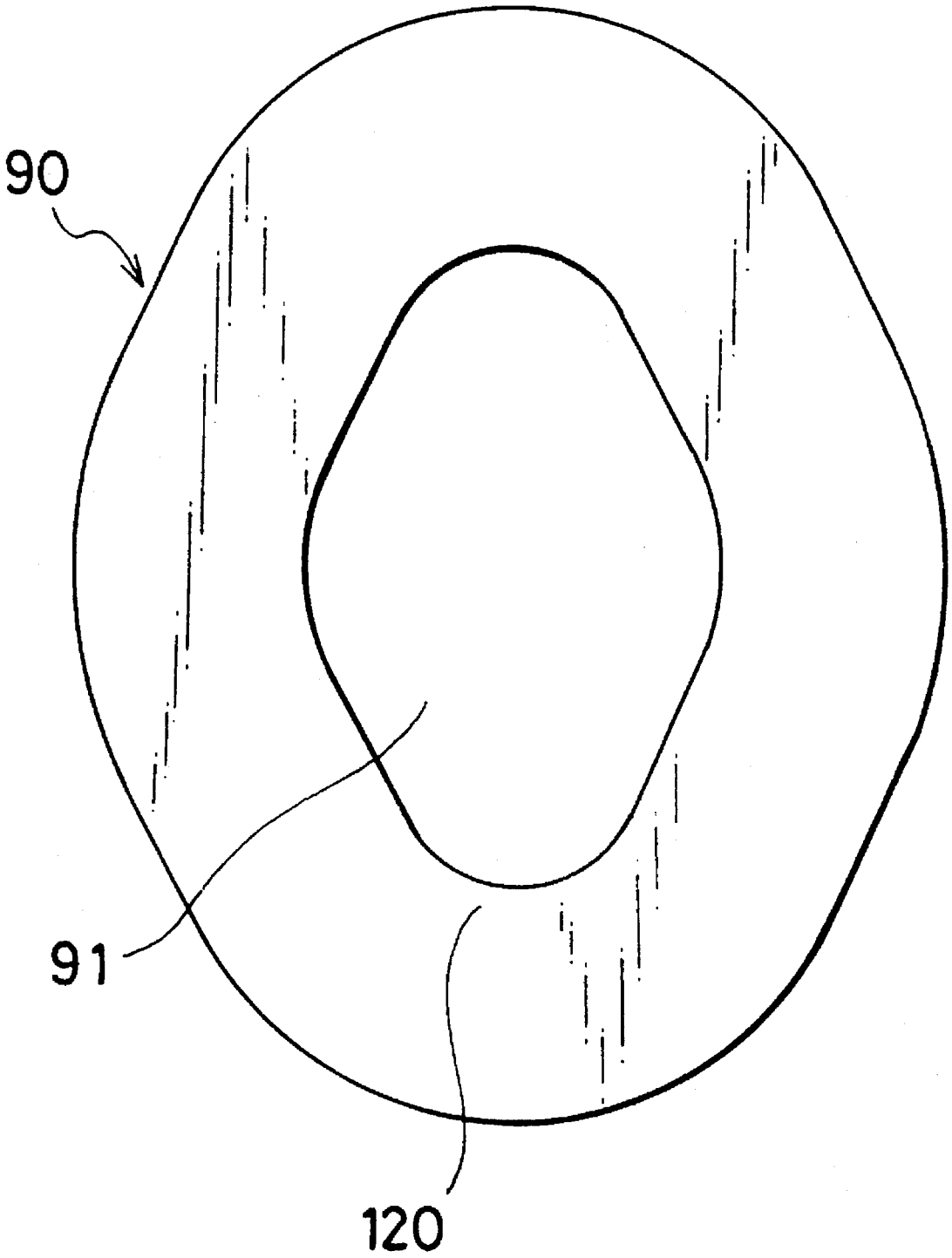
FIG. 7 is a top plan view of the armature stopper according the embodiment of the invention illustrated in FIG. 5.

The armature stopper 90 is made of a plain plate having a top plan configuration which is substantially the same as a space surrounded by an outer edge of the standing wall 81. As shown in FIG. 7, a window bore 91 is formed at a center. An integral armature abutting portion 120 is formed along a periphery of the window bore 91.

The armature stopper 90 as best seen in FIG. 6 is abutted against the front end surface of the standing wall 81, and projections indicated by the broken line and beforehand formed respectively at a plurality of locations on an outer peripheral edge portion of the standing wall 81 are dissolved by ultrasonic waves, to thereby form inhibit or suppression portions 92. By the suppression portion 92, the outer edge portion of the armature stopper 90 is restrained or pressed down. Thus, the armature stopper 90 is mounted on the armature base 80.

Then, a gap 140 corresponding to the height of the standing wall 81 is defined at the back of the armature abutting portion 120 of the armature stopper 90.

In the present embodiment, since the armature stopper 90 is formed by the simple annular planar plate, it is not required to apply complicated or complex processing. Thus, it is possible to keep the cost of the device correspondingly low.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A printing head, comprising:

a plurality of armatures, arranged radially and supported to be swingable in a back and forth movement;

an armature stopper, formed of a material having wear and abrasion resistance, having a central bore and armature abutting portions of cantilever type projecting in a radial direction toward the bore and disposed at a rear of said armatures for positioning the armatures under a waiting condition, said armature abutting portions being displaceable towards a gap defined at a rear of said armature abutting portions by impingement thereon of said armatures;

an armature stopper table having a bore and an annular projection on a front surface and arranged at a rear of said armature stopper in the form of a planar plate, for defining the gap corresponding to a height of said projection; and an armature base having a front surface abutting said rear of the armature stopper and a projection provided at a center of said front surface, said projection being inserted into the bore of the armature stopper and the bore of the armature stopper table so that said armature stopper and said armature stopper table are mounted on said armature base.

2. A printing head according to claim 1, wherein:

said armature abutting portions are formed in a plurality and are disposed radially.

3. A printing head according to claim 1, wherein:

said armature stopper is made of a planar plate in which a window bore is formed at a center of said planar plate, and the armature abutting portions are formed along a periphery of the window bore.

4. A printing head, comprising:

a plurality of armatures, arranged radially and supported to be swingable in a respective back and forth movement;

an armature base disposed at a rear of said armatures;

an armature stopper, formed of a material having wear and abrasion resistance, having a central bore and armature abutting portions of cantilever type projecting in a radial direction toward the bore and disposed at a rear of said armatures for positioning the armatures under a waiting condition, said armature abutting portions being displaceable towards a gap defined at a rear of said armature abutting portions by impingement thereon of said armatures; and wherein said armature stopper has the form of a planar plate and has an outer edge, and an annular standing wall is formed on said front surface of said armature base, the outer edge of the planar plate being mounted on said front end surface of the wall, for defining the gap corresponding to a height of said standing wall.

5. A printing head according to claim 4, wherein:

said armature abutting portions are formed along a peripheral direction and continuously.

6. A printing head according to claim 4, wherein:

said outer edge of the armature stopper is abutted against the front end surface of said standing wall; and a plurality of suppression portions are formed at selected locations at an outer peripheral edge portion of said end surface of said standing wall, and the armature stopper is clamped to the suppression portions.

7. A printing head according to claim 4, wherein:

said armature stopper is made of a planar plate in which a window bore is formed at a center of said planar plate, and the armature abutting portions are formed along a periphery of the window bore.

* * * * *